United States Patent [19]

Lombardo

[11] Patent Number: 4,779,792

[45] Date of Patent: Oct. 25, 1988

[54] RETURN MAILER ASSEMBLY AND RELATED PROCESS

[75] Inventor: Leo Lombardo, Manchester, N.H.

[73] Assignee: Moore Business Forms, Inc., Grand Island, N.Y.

[21] Appl. No.: 156,588

[22] Filed: Feb. 17, 1988

[51] Int. Cl.[4] ..... B65P 27/06

[52] U.S. Cl. ..... 229/73; 229/69

[58] Field of Search ..... 229/73, 68 R, 69, 71

[56] References Cited

U.S. PATENT DOCUMENTS

| | | | |
|---|---|---|---|
| 2,395,419 | 2/1946 | Mitchell | 117/68.5 |
| 2,478,070 | 8/1949 | Wood | 106/248 |
| 3,261,623 | 7/1966 | Kiedrowski | 229/69 |
| 3,411,699 | 11/1968 | Pine et al. | 229/73 |
| 3,523,050 | 8/1970 | Campbell | 156/289 |
| 3,681,105 | 8/1972 | Milutin et al. | 117/15 |
| 3,905,545 | 9/1975 | Juszak et al. | 229/73 |
| 3,941,308 | 3/1976 | Digirolomo et al. | 229/69 |
| 3,981,435 | 9/1976 | Johnsen | 229/73 |
| 4,055,294 | 10/1977 | Traise | 229/69 |
| 4,095,695 | 6/1978 | Steidinger | 229/69 |
| 4,310,117 | 1/1982 | Gullett | 229/73 |
| 4,669,652 | 5/1987 | Seguin | 229/73 |

FOREIGN PATENT DOCUMENTS 201960 11/1986 European Pat. Off. ..... 229/68 R

*Primary Examiner*—Willis Little

*Attorney, Agent, or Firm*—Nixon & Vanderhye

[57] ABSTRACT

A return mailer assembly comprising a pair of outer webs and an intermediate web, the first and second outer webs forming a first envelope, and the intermediate and second outer webs forming a return envelope portion, separable from the other outer web. To facilitate and increase the speed of production of such assemblies, a dry-gummed paper stock is sued for one or both of the webs which form the return envelope portion. At least one of the inner surfaces of the return envelope forming webs, as well as an envelope sealing flap portion, are provided with a gummed composition, i.e., a rewettable adhesive. A moisture barrier is applied to preselected areas of one or both of the facing, inner surfaces of the intermediate and second outer webs to prevent activation of the gummed surface, except in peripheral border portions where the return envelope forming webs are joined.

24 Claims, 2 Drawing Sheets

Fig. 1
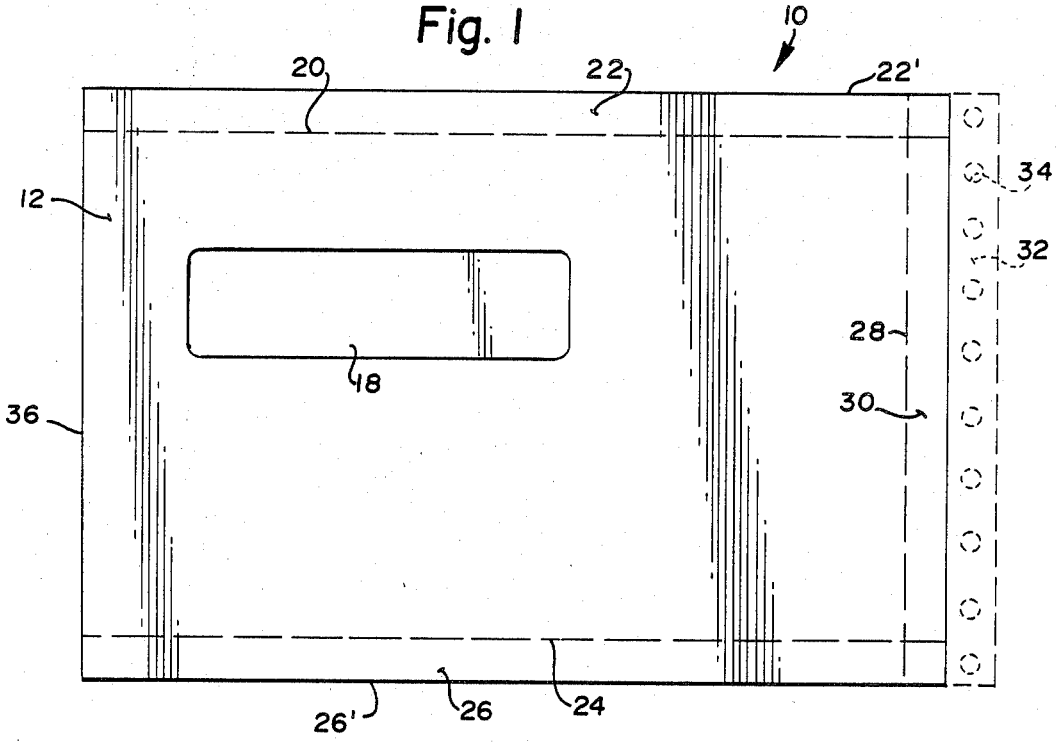
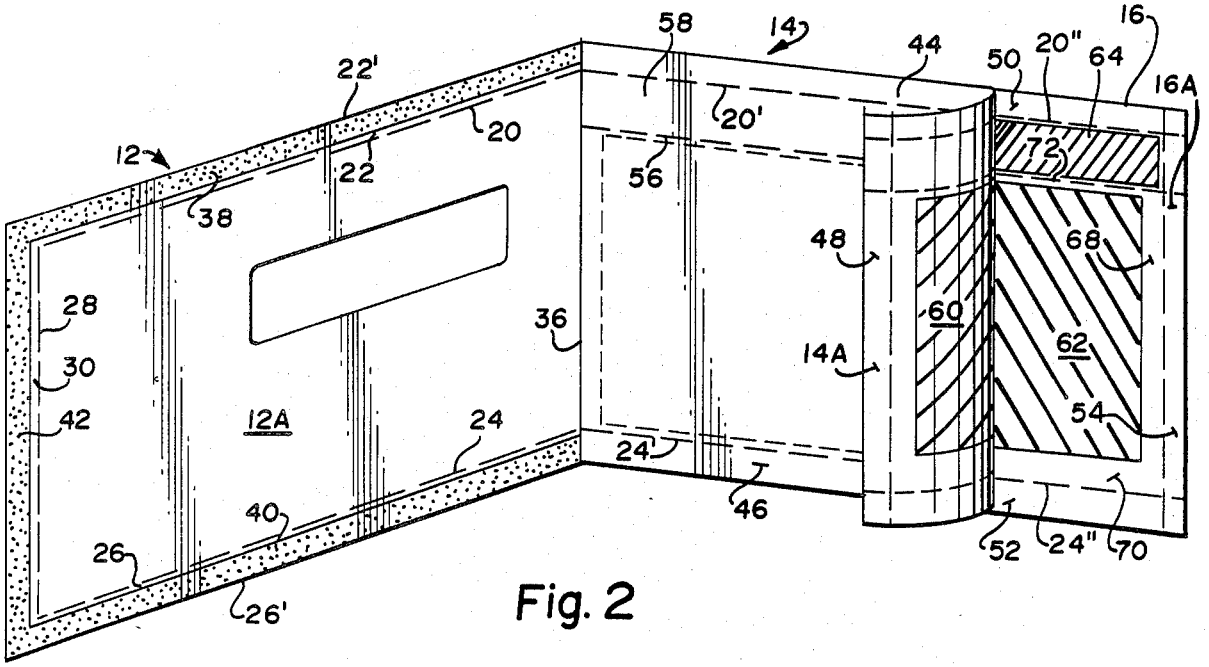
Fig. 2

RETURN MAILER ASSEMBLY AND RELATED PROCESS

BACKGROUND AND SUMMARY OF THE INVENTION

The present invention relates generally to a combined mailer and return envelope assembly, and more particularly to an improved assembly utilizing dry gummed stock for at least one of the webs forming the return envelope portion of the assembly.

Return mailer assemblies are known, per se, and reference is made to U.S. Pat. Nos. 4,669,652, 4,055,294 and 3,261,623 for illustrative examples.

However, in the past, heat or pressure sensitive adhesives have been used to secure the peripheral portions of the webs forming the return envelope portion of the assembly. The placement of heat sensitive adhesive in, for example, a U-shaped pattern for adhering the envelope-forming webs is a slow and energy intensive process, and, in the continuous production of such assemblies, finishing speeds of no more than 30 F.P.M. are experienced. In addition, the use of heat sensitive adhesives can produce excessive tenting in the continuous forms assembly. Similarly, the use of pressure sensitive adhesives requires additional manufacturing steps since this type of adhesive is typically covered with separate strips of release tape for later removal by the user.

The present invention overcomes these problems by providing an adhesive scheme for the return envelope forming webs which increases production speeds significantly, without in any way decreasing the quality of the finished mailer assembly. The return mailer assembly of this invention is constructed of three superimposed webs, wherein in a preferred embodiment, first and second outer webs comprise front and rear panels, respectively, of a first mailing envelope, while the intermediate web combines with the second outer, or rear panel, to form a return envelope assembly.

In accordance with the present invention, at least one of the intermediate and second outer webs, and preferably the intermediate web which forms the front web of the return envelope, is formed of dry-gummed paper stock where one of the web surfaces is gummed, i.e., provided over its entire surface with a rewettable adhesive coating. The web is arranged so that the gummed side comprises the "inner" surface of the one web, i.e., the surface which faces the interior of the envelope.

In this regard, throughout this disclosure, those surfaces of the intermediate and second outer webs which face and engage each other will be referred to as the "inner" surfaces of the return envelope portion of the assembly. Opposite surfaces of each of these webs comprise "outer"surfaces of the return envelope portion of the assembly.

Of course, since the adhesive is needed only about three peripheral border portions of one return envelope forming web for adherence to corresponding portions of the other return envelope forming web, (as well as the return envelope sealing flap, as described further herein) care must be taken to prevent the remaining interior surface portions of the web from exposure to moisture. In accordance with this invention, in order to render parts of the return envelope gummed surface inactive, and thereby prevent the interior surfaces of the return envelope webs from sticking, a moisture barrier is applied to predetermined areas of the inner surfaces of the webs forming the return envelope portion. One such predetermined area corresponds substantially to the entire gummed inner surface of the intermediate web, with the exception of the above-mentioned peripheral borders along three edges of the web. Another such area is a removable flap portion formed in the second outer web, and which faces and engages a sealing flap portion of the intermediate web. Thus, in the case where the inner surface of the intermediate web of the mailer assembly is gummed, the moisture barrier is applied over substantially the entire inner surface of this web, as well as a portion of the inner surface of the second outer web, corresponding to and directly aligned with, the gummed sealing flap portion of the intermediate web which comprises the front web of the return envelope. It will be understood that the moisture barrier cannot be applied directly to the gummed sealing flap portion of the front web since the adhesive there must be utilized by the user to seal the return envelope. Nevertheless, the sealing flap must be protected from moisture until the return envelope is used.

As previously mentioned, in the preferred form, only the intermediate web forming the front web of the return envelope is formed of dry-gummed paper stock.

It is, of course, within the scope of this invention that both webs which form the return envelope portion be formed of dry-gummed paper stock, with the inner surfaces of both coated entirely with a gummed composition. In this embodiment, one or both of the gummed surfaces may be provided with a moisture barrier in the aforesaid preselected areas.

In the preferred embodiment, the moisture barrier comprises a vegetable-based ink which may be printed on the gummed surface. However, other moisture barrier compositions, also capable of being printed, may be employed.

Accordingly, in its broader aspects, the return mailer assembly of this invention comprises:

at least one outer web separably attached to a return envelope portion, wherein the return envelope portion of said assembly includes a front panel having inner and outer surfaces;

a rear panel having inner and outer surfaces;

the inner surface of at least one of the front and rear panels comprising stock provided with rewettable adhesive over its entire surface area, and wherein the inner surfaces of the front and rear panels are provided with a water impervious composition in selected areas to prevent sticking of the first and second panels in those selected areas.

The present invention also relates to a process for forming the above-described return mailer, which process includes the steps of:

(a) providing first, second and third webs wherein two of the three webs form a return envelope portion;

(b) coating the inner surface of at least one of the webs forming the return envelope portion with a rewettable adhesive;

(d) applying a moisture barrier to predetermined areas of the inner surfaces of the return envelope forming webs in order to prevent sticking of the webs in said areas, and to permit adhesive assembly of the two webs in areas other than said predetermined areas; and (e) assembling said first, second and third webs in superimposed relationship.

Utilizing the invention described herein, it is thus possible to eliminate the separate adhesive application, heating, and/or release tape application steps required in conventional return mailer production, and, at the same time, to significantly increase production speeds and hence output.

Other objects and advantages of the invention will become apparent from the detailed description which follows.

BRIEF DESCRIPTION OF THE DRAWINGS

FIG. 1 is a front view of a return mailer assembly in accordance with the invention;

FIG. 2 is a perspective view of the return mailer assembly of claim 1, with the front sheet opened and the intermediate sheet peeled back to illustrate the layered construction of the return envelope portion of the mailer.

DETAILED DESCRIPTION OF THE DRAWINGS

Figure 3:
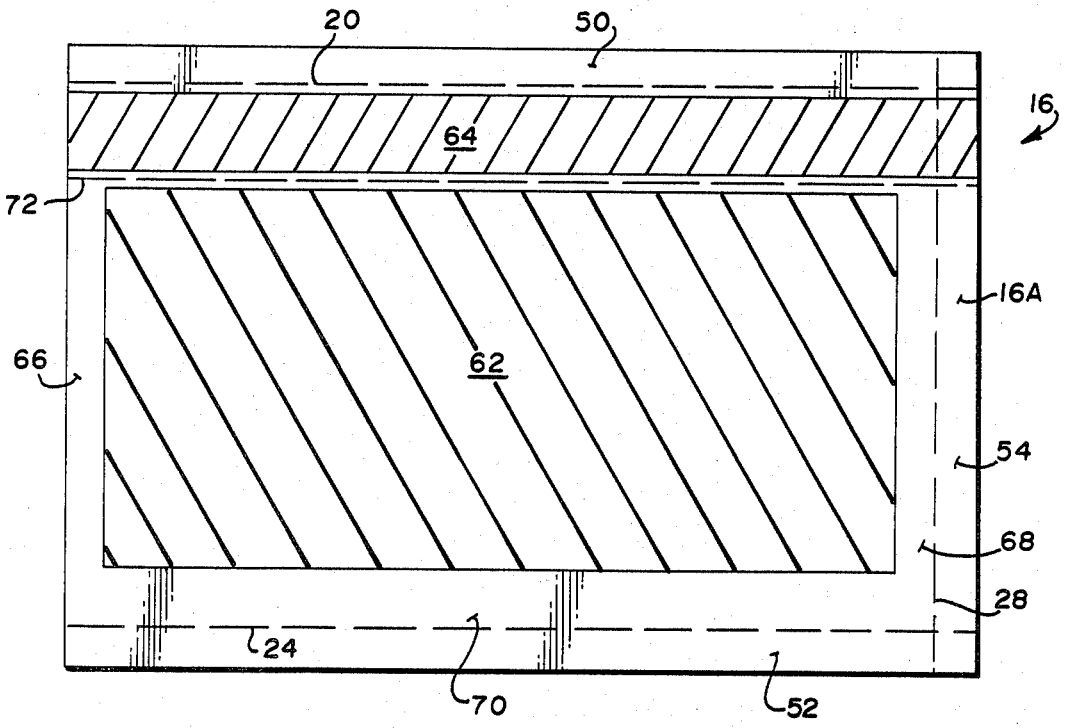
FIG. 3 is a front view of the rear sheet of the return mailer of the invention.

Referring now to FIGS. 1–3 of the drawings, a multipart return mailer assembly 10 is illustrated which includes a first outer web or cover sheet 12, an intermediate web 14, and a second outer web 16. In this return mailer assembly, the first and second outer webs 12 and 16 form a first envelope, while the intermediate web 14 and the second outer web 16 combine to form a return envelope portion. As such, the intermediate web 14 forms the front panel of the return envelope and the second outer web 16 forms the rear panel of the return envelope. Upon receipt by the addressee, the first outer web 12 is separable from the intermediate and second outer web as will be explained further hereinbelow.

The first outer web, or cover sheet 12 is comprised of paper or other conventional stock, and is provided with a cut-out window portion 18 which, in conventional constructions, may be covered by a transparent flap or the like so as to display the name and address of the addressee. Other arrangements for displaying an address may be employed, and this feature does not constitute part of this invention.

An upper perforation line 20 extends across the top of the web 12, but spaced from the upper edge thereof, to provide a removable stub 22. In a similar manner, a lower perforation line 24 extends across the web spaced from the lower edge to provide a lower removal stub 26. At the same time, a vertically oriented, third perforation line 28 defines a removable side stub 30. As shown in phantom in FIG. 1, a marginal feed strip 32 including tractor feed holes 34 will typically have been utilized during the manufacture of the mailer in a continuous forms arrangement, but is subsequently removed prior to use. In this regard, it will be appreciated that webs 12, 14 and 16 may initially be part of a continuous forms assembly, each individual unit being separable along longitudinally spaced, transverse lines of perforations, coincident with upper and lower edges 22' and 26'.

The perforation lines 20, 24 and 28 are formed in all three of the webs 12, 14 and 16 so that identical and superimposed removable stubs are formed in all three webs. This arrangement permits each aligned set of three removable stubs extending along the upper, lower, and side edges, respectively, to be torn from the form simultaneously as will be explained in greater detail below. For simplification and clarification, the corresponding perforation lines formed in webs 14 and 16 are designated by the same reference numerals 20, 24 and 28, as used in web 12, but with prime and double prime designations, respectively.

It will be appreciated that webs 12, 14 and 16 may be separately formed and assembled in superimposed relationship, or, in a preferred arrangement, the first and second outer webs 12 and 16 may be formed from a single sheet folded to define a side edge 36 such that webs 12 and 16 enclose or sandwich a slightly axially shorter web 14 therebetween. In this arrangement, and to facilitate removal of the outer web 12 by the addressee, side edge 36 may be provided with a series of longitudinal perforations to define a tear line extending substantially parallel to the perforation line 28.

With specific reference to FIG. 2, it may be seen that the inside surface **12*a* of the outer web 12 is provided with lines of adhesive 38, 40, 42, typically of the heat or pressure sensitive type, and which extend along the removable stubs 22, 26 and 30. These heat or pressure sensitive adhesive lines serve to secure the outer web 12 to the intermediate web 14 along aligned removable stubs 44, 46, and 48 on the intermediate web 14 defined by perforation lines 20', 24', and 28'. In a similar manner, the second outer web 16 has peripheral, movable stubs 50, 52 and 54 formed by aligned perforation lines 20'', 24'' and 28''**. The manner in which the intermediate and second outer webs are adhered along their respective removable stubs will be described further below.

The intermediate web 14 is further characterized by an additional perforation line 56 extending substantially parallel to perforation line 20 but vertically spaced therefrom to serve as a fold line for a return envelope sealing flap 58.

The improvement of this invention over conventional prior art return mailer assemblies, lies in the construction of intermediate web 14 and/or the second outer web 16 which combine to form the return envelope portion of the assembly. In a preferred embodiment, the stock of which the intermediate web 14 is formed is preferably of the dry gummed paper type, wherein a rewettable adhesive is provided over the entirety of one of the web surfaces. The adhesive is activated upon application of moisture, as is well understood by those of ordinary skill in the art. One particularly suitable dry gummed stock is that known as Nashua Davac® produced by the Nashua Corporation of Nashua, New Hampshire. One advantage of this particular stock is that it can be printed on the gummed side, and this feature as already explained, is of considerable significance to this invention.

In the present invention, as already mentioned, the inner surface **14*a* of web 14 is gummed, i.e., provided with a rewettable adhesive coating. Since surfaces 14*a* and 16*a* of the webs 14 and 16 are normally in full surface contact with each other, care must be taken to prevent exposure of the gummed surface 14*a* to moisture. For example, moisture added or removed during the manufacturing process could otherwise cause webs 14 and 16** to stick to each other, thereby ruining the return mailer envelope assembly.

In this invention, advantage is taken of the gummed label stock printing feature to the extent that a predetermined area of the gummed surface **14*a*** is provided with an ink pattern, and more specifically an ink pattern which serves as a moisture barrier to the gummed surface to which the pattern is applied.

The moisture barrier is preferably a vegetable based ink, and preferably, one sold under the brand name NoTox® manufactured by Colorcon, Inc. of West Point, Pennsylvania. This non-toxic and contaminant-free ink is suitable for wet or dry offset, letter press, heat-set or non-heat web offset, flexographic, gravure, pad printing, and silkscreen printing processes, thus providing a great deal of flexibility in the manufacture of the return mailer assembly. It will be understood by those of ordinary skill in the art that other vegetable based inks which have good moisture barrier characteristics may also be employed. Typically, of course, the application of the rewettable, gummed adhesive and the preselected printing patterns will be performed prior to the manufacture of the return mailer assembly, thereby enabling considerably higher mailer production speeds.

Referring again to FIGS. 2 and 3, it may be seen that an ink pattern 60 has been applied to the surface 14*a* of web 14 which forms one of the inner surfaces of the return envelope. In an alternative arrangement, a corresponding pattern 62 may be applied on the inner surface 16*a* of web 16 to provide increased moisture resistance. A third pattern 64 is provided on surface 16*a*, over an area corresponding substantially to the return envelope sealing flap 58 formed on web 14. As can be seen from the drawings, the pattern 60 (and 62 if utilized) will prevent sticking between substantially the entire surfaces 14*a* and 16*a*, corresponding to the inner surfaces of the envelope. However, peripheral portions 66, 68 and 70 of surface 16*a* (best seen in FIG. 3) and corresponding portions of surface 14*a* are left uninked so that webs 14 and 16 may be adhesively secured in these areas, upon application of moisture, to form the return envelope. The uninked area also includes the removable stub portions 44, 46 and 48 of web surface 14*a*, and 50, 52 and 54 of web surface 16*a*.

The pattern 64 prevents the envelope flap portion 58 from sticking to the web 16. However, flap 58 is not itself inked so that, when it is desired to use the return envelope, it may be moistened and secured to flap 16 when folded about line 58.

It will thus be understood that in the completed return mailer assembly, the first outer web 12 is secured to intermediate web 14 about the adhesive lines 38, 40 and 42, while at the same time, web 14 and second outer web 16 are adhesively secured in all areas of surface engagement with the exception of the inked pattern areas 60 and 64 (and, optionally, area 62).

As previously indicated, both webs 14 and 16 may be formed of dry gummed paper stock, with facing interior surfaces 14*a*, 16*a* provided with a rewettable adhesive coating. In this arrangement, inked areas 60 and 64 remain as previously described. However, because of the increased adhesive composition present on the inner surfaces of the return envelope, it is preferred that inked pattern 62 be applied to surface 16*a* as well to insure that surfaces 14*a* and 16*a* do not stick in other than the intended areas.

In use, the return mailer assembly is opened by removing the peripheral stub portions in sequential order. For example, the user may first tear the assembly along perforation lines 28, 28' and 28'' to remove peripheral stub portions 30, 48 and 54. The user may then tear along perforation lines 20, 20' and 20'' to remove stub portions 22, 44 and 50 along the top edge of the form, and thereafter along the lower perforation lines 24, 24' and 24'' to remove the lower peripheral stub portions 26, 46 and 52. The outer or cover web 12 may then be peeled back and torn along edge 36 leaving the return envelope formed by webs 14 and 16 intact.

Typically, the inside surface of web 12 will include billing or other account information and may have a separable return receipt portion which is returnable in the envelope formed by webs 14 and 16.

In order to use the return envelope, the user thereafter removes that portion of web 16 covered by the ink pattern 64 along a perforation line 72 so that the return envelope sealing flap 58 on the web 14 may subsequently be folded along line 56, moistened, and secured to the exterior surface of the web 16 in a conventional manner.

The present invention also includes within its scope a process for forming a return mailer assembly of the type described hereinabove. The preferred process, in its broader aspects, includes the following steps:

(a) providing first second and third webs 12, 14 and 16, respectively;

(b) applying lines of adhesive 38, 40, 42 to at least three peripheral border portions of the first outer web 12 for releasably attaching the first outer web 12 to the intermediate web 14;

(c) coating at least the inner surface 14*a* of the intermediate web 14 with a rewettable adhesive; and (d) applying a moisture barrier in predetermined patterns 60 and 64 (and, optionally, 62) on surfaces 14*a*, 16*a*, respectively to prevent the inner surface portions of the return envelope from sticking.

Alternatively, step (c) and (d) may also include the application of a rewettable adhesive to surface 16*a* and, preferably, the application of a moisture barrier in area 62 as described hereinabove.

Accordingly, the present invention simplifies the production of return mailer assemblies by eliminating the previously required steps of applying heat or pressure sensitive adhesives (and heating in the case of heat sensitive adhesives) to selected areas of the inner surfaces of the return envelope portion of the assembly, thereby achieving substantially higher production speeds with no adverse affect on the overall quality of the mailer.

It will further be appreciated that the utilization of dry gummed label stock is equally applicable to other envelope constructions and other types of business forms.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim

1. A return mailer assembly comprising at least one outer web separably attached to a return envelope portion wherein said return envelope portion of said assembly comprises a front panel having inner and outer surfaces;

a rear panel having inner and outer surfaces;

at least one of said front and rear panels comprising dry-gummed paper stock wherein the outer surface of said at least one panel is ungummed and the inner surface of said at least one panel is gummed, and wherein said gummed inner surface of said at least one panel is partially coated with a water impervious composition in at least one preselected area to prevent sticking of said inner surfaces of said front and rear panels in said preselected area.

2. A return mailer assembly as defined in claim 1 wherein said at least one panel comprises the front panel of said return envelope portion.

3. A return mailer assembly as defined in claim 2 wherein said preselected area includes a portion of said inner surface of said front panel corresponding substantially to the entire interior of said envelope with the exception of interior peripheral border portions.

4. A return mailer assembly as defined in claim 1 wherein both front and rear panels comprise dry-gummed paper stock, and wherein the inner surfaces of both front and rear panels are gummed and coated with a water impervious ink in preselected areas.

5. A return mailer assembly as defined in claim 3 and wherein a removable flap portion is formed in said rear panel, which removable flap portion engages a corresponding sealing flap portion provided on the front panel of said return envelope portion, said removable flap portion also being coated with a water impervious composition.

6. A return mailer assembly as defined in claim 1 wherein said water impervious composition comprises vegetable-based ink.

7. A return mailer assembly as defined in claim 5 wherein said water impervious composition comprises vegetable-based ink.

8. In a return mailer assembly which comprises a first outer web, an intermediate web and a second outer web wherein the first outer web is removable from said intermediate and second outer webs, and wherein said intermediate and second outer webs comprise a return envelope portion, inner surfaces of which are in substantially complete surface engagement, the improvement comprising:

at least one of said intermediate and second outer webs are constructed of stock coated on an inner surface with a rewettable adhesive, and wherein at least one of said inner surfaces is provided with a moisture barrier in one or more predetermined areas to prevent sticking of the inner surfaces of said intermediate and second outer webs in said predetermined areas.

9. The return mailer assembly as defined in claim 8 wherein said stock comprises dry gummed paper stock.

10. The return mailer assembly as defined in claim 8 wherein said moisture barrier comprises vegetable-based ink.

11. The return mailer assembly as defined in claim 9 wherein said moisture barrier comprises vegetable-based ink.

12. The return mailer assembly as defined in claim 8 wherein inner surfaces of both intermediate and second outer webs are provided with a moisture barrier in predetermined areas to prevent sticking of said inner surfaces in said areas.

13. The return mailer assembly as defined in claim 12 wherein said stock comprises dry gummed paper stock.

14. The return mailer assembly as defined in claim 13 wherein said moisture barrier comprises vegetable-based ink.

15. The return mailer assembly as defined in claim 8 wherein said intermediate web is provided with a return envelope sealing flap, and wherein said predetermined areas includes an inner surface portion of said second outer web opposed and in engagement with said return envelope sealing flap.

16. The return mailer assembly as defined in claim 15 wherein said predetermined areas further include substantially the entire inner surface of the intermediate web with the exception of peripheral border portions which enable adhesive securement of the intermediate and second outer webs.

17. An envelope assembly comprising a front panel having inner and outer surfaces;

a rear panel having inner and outer surfaces;

at least one said front and rear panels comprising dry-gummed paper stock wherein the outer surface of said at least one panel is ungummed and the inner surface of said at least one panel is gummed, and wherein said gummed inner surface of said at least one panel is coated with a water impervious composition in at least one preselected area to prevent sticking of said inner surfaces of said front and rear panels in said preselected area.

18. An envelope assembly as defined in claim 17 wherein said at least one panel comprises the front panel, and wherein said at least one preselected area corresponds to substantially the entire interior of said envelope with the exception of interior peripheral border portions.

19. An envelope assembly as defined in claim 18 a removable flap portion is formed in said rear panel, which removable flap portion engages a corresponding sealing flap portion provided on said front panel, said removable flap portion also being coated with a water impervious composition.

20. An envelope assembly as defined in claim 19 wherein wherein said water impervious composition comprises vegetable-based ink.

21. In a method of forming a return mailer assembly, the steps comprising (a) providing first, second and third webs wherein two of the three webs form a return envelope portion;

(b) coating an inner surface of at least one of the webs forming the return envelope portion with a rewettable adhesive;

(c) applying a moisture barrier to predetermined portions of inner surfaces of the return envelope forming webs to prevent sticking of said return envelope forming webs in said portions, and to permit adhesive assembly of said return envelope forming webs in areas other than said predetermined portions; and (d) assembling said first, second and third webs in superimposed relationship.

22. The method of claim 21 wherein step (b) is practiced by providing dry-gummed paper stock.

23. The method of claim 22 wherein step (c) is practiced by applying a vegetable-based ink pattern to said predetermined portions.

24. The method of claim 23 wherein one of said predetermined portions includes substantially the entire inner surface of one of said return envelope forming webs with the exception of three peripheral border portions, and another of said predetermined portion includes the inner surface of a removable flap portion formed in the other of said return envelope forming webs, said removable flap portion facing a sealing flap portion of said one of said return envelope forming webs.

* * * * *